United States Patent [19]

Mairy

[11] 4,162,699

[45] Jul. 31, 1979

[54] CONTROLLING CONTINUOUS CASTING

[75] Inventor: Bernard G. Mairy, Sclayn-Andenne, Belgium

[73] Assignee: Centre de Recherches Metallurgiques-Centrum voor Research in de Metallurgie, Brussels, Belgium

[21] Appl. No.: 839,413

[22] Filed: Oct. 5, 1977

[30] Foreign Application Priority Data

| | | | |
|---|---|---|---|
| Oct. 5, 1976 | [BE] | Belgium | 846970 |
| Apr. 15, 1977 | [BE] | Belgium | 853687 |
| Jun. 20, 1977 | [BE] | Belgium | 646061 |

[51] Int. Cl.[2] ..... B22D 11/16

[52] U.S. Cl. ..... 164/4; 164/73

[58] Field of Search ..... 164/73, 4, 154, 416

[56] References Cited

U.S. PATENT DOCUMENTS

| | | | |
|---|---|---|---|
| 2,824,346 | 2/1958 | Osborn | 164/154 X |
| 3,478,808 | 11/1969 | Adams | 164/4 |

FOREIGN PATENT DOCUMENTS

| | | | |
|---|---|---|---|
| 466939 | 7/1975 | U.S.S.R. | 164/154 |

*Primary Examiner*—Robert D. Baldwin

*Attorney, Agent, or Firm*—Holman & Stern

[57] ABSTRACT

A continuous casting process, in which the upper surface of the molten metal in the mold is covered by a protective powder, is controlled. The acceleration spectrum of the mold is recorded and compared with an ideal spectrum corresponding to optimum quality of the ingot skin. Any difference observed between the two spectra is taken up by modifying a parameter having an effect on the ingot quality at the time at which it is formed in the mold.

8 Claims, 2 Drawing Figures

CONTROLLING CONTINUOUS CASTING

Figure 1:
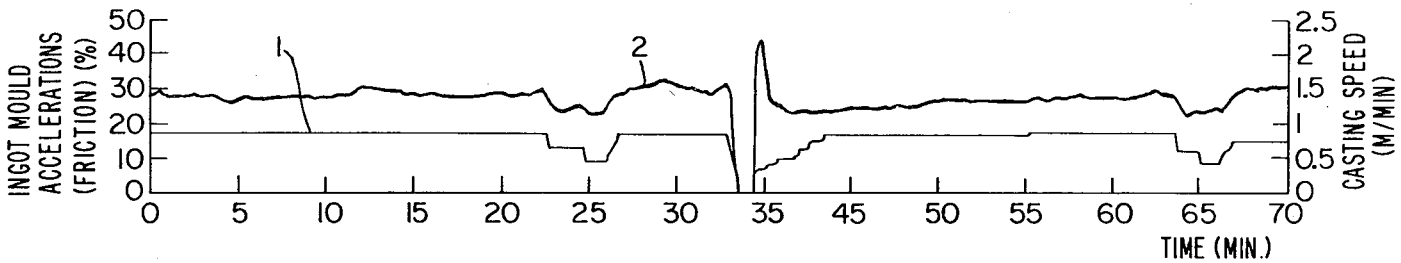

The present invention relates to a method of controlling the continuous casting of metals and in particular of steel.

The following description deals mainly with the particular case of continuous steel casting, but this is given solely by way of example, the invention actually relating to the continuous casting of metals in general, whether elementary metals or alloys.

It is well known that in the continuous steel casting process, especially in the case of casting ingots of large cross-section, for example slabs, the liquid upper surface of the ingot being cast is covered with a powder of appropriate composition. The constant placing in contact of the powder with uninterruptedly renewed metal is commonly obtained by means of an appropriate configuration of the extremity of the casting nozzle which continually directs at least a part of the metal traversing it towards the said powder.

The powder in question commonly comprises CaO, $SiO_2$, $Al_2O_3$, and fluxes such as for example $CaF_2$, $K_2O$, $Na_2O$, as well as—most often—carbon in the form of graphite or coke, in proportions varying with the characteristics of the ingot which is to be cast and of the casting action. Its function is manifold, in particular with respect to air, to assure a satisfactory heat insulation of the upper surface of the ingot and protect it against oxidization, to absorb the inclusions present in the steel, to act as a lubricant between the ingot and the mold, and to ensure optimum heat transfer from the ingot to the mold, whilst adapting to oscillations imposed on the mold.

The monitoring of the casting process is currently performed by observing the appearance and behaviour of the external surface of the ingot during its cooling from the point at which the same issues from the sprinkling section of the casting machine up to the point at which its complete solidification is certain.

This method nevertheless has the disadvantage that particular surface faults are detected somewhat belatedly only, and that the measures intended to act against these cannot avoid a particular time-lag in becoming effective. It hardly renders it possible to avert the need to reject or at least downgrade occasionally substantial sections of the cast ingot.

What is desired is a method rendering it possible to detect and prevent the principal surface faults of a continuously cast ingot in a continuous manner and actually with the mold. It should also render it possible to detect a geometrical anomaly of the mold.

The method of the present invention is based on the unexpected discovery that a relationship prevails between the actual displacements of the mold during the continuous casting operation and the quality of its lubrication by means of the covering powder.

In a method according to the present invention, for a powder of given composition, the external appearance of the metal emerging from the machine is observed and the actual displacements of the mold are recorded, as are preferably its accelerations, the composition of the powder is modified in tha appropriate direction until the quality of the ingot skin may be considered an optimum, to which corresponds the optimum lubrication of the ingot mold and a range or spectrum of its accelerations considered to be ideal, and thereafter the mold acceleration range recording is continued, the same being compared to that considered to be ideal, and either the composition of the powder or any other parameter having an action on the quality of the ingot at the time in which it is formed in the ingot mold, for example the speed of ingot withdrawal, is modified in the appropriate direction to take up any difference observed between the two ranges.

It is obvious that it is possible to apply an ideal range to a subsequent casting operation having analogous characteristics; in this case, the comparison between the momentary range or spectrum and the ideal range may be initiated right from the beginning of the casting operation, without again having to undertake observations of the skin of the ingot. In this manner, it is possible to secure immediate data on the quality of the ingot and to proceed without any delay with the appropriate steps which would become mandatory in the case in which this quality is not considered to be satisfactory.

To eschew any confusion regarding the meaning to be ascribed to the term "acceleration" as used above, it should be considered that the displacement of the mold derive from two simultaneously acting causes, being:

a commonly sinusoidal oscillatory displacement of very low frequency (for example 1 cycle/sec) mechanically impressed on the mold. A very low acceleration obviously corresponds to this displacement.

disturbances which arise as soon as the continuous casting process begins and which are caused by unavoidable frictional actions which are variable locally and chronologically. These disturbances modify the theoretical displacement of the mold, which causes the appearance of momentary changes of its speed in one direction or the other, and by way of consequence, acceleration.

An accelerometer secured to the mold renders it possible to obtain at all times a direct reading of the components of the acceleration, other than those caused by the oscillation imposed on the mold. It is the observation of these components which lies at the root of the method of the invention.

It does not, however, lie beyond the scope of the invention to contemplate the recording of the displacements of the mold by means of several accelerometers, not necessarily integral with the mold but simply coupled mechanically to it or to its bearer. Analogously, this recording may proceed on the basis of the displacements of the mold or of its speed.

The proposed modification of the powder may be interpreted either as a partial change in its composition or as complete replacement of the powder. This change may be accompanied by a variation of the speed of withdrawal intended to discover the optimum withdrawal speed for a given powder. Conversely, if the withdrawal speed cannot be modified in practice, it is possible to modify the composition or quantity of the powder systematically to discover the optimum features or quantity.

For example, it is thus that it is possible within the scope of the invention to undertake a measurement of the interference vibrations of the mold along the axis of the ingot upon issuing from the mold on the one hand, and on the other hand along one or more directions included within a plane which is preferably at right angles to the axis of the ingot. It has been observed that the recordings of the interference vibrations of the mold along these axes comprised frequency ranges of special interest for observing a relationship between the magnitude of the speeds measured and the intensity of the frictional actions between the ingot and the mold, and consequently the quality of the lubrication by means of the covering powder.

In the case of an acceleration measurement taken along the axis of the ingot, the section of greatest interest discovered comprised the frequencies lower than 80 times the maximum frequency of the oscillation imposed on the mold, whilst along a direction at right angles to this axis, the section of greatest interest discovered comprises between 0.1 and 10 times this same maximum frequency.

Equally, the knowledge of the normal correspondence between the quantity selected to characterise the displacements of the mold on the one hand and the casting speed on the other hand, may act as a guide for instantaneously detecting any anomaly in the lubrication of the mold or in the leading sprinkling sections, as well as unsatisfactory adjustment of the line, which represents a particularly important advantage and renders it possible to avert serious mishaps, such as a puncture of the ingot for example.

In this context, the following graphs given by way of non-limiting example, render it possible to grasp the ease and efficiency of the method.

FIG. 1 shows a recording of a type which may be considered as being normal. The graph 1 corresponding to the casting speed in m/min (scale of the ordinates at the right-hand side), and the graph 2 corresponding to the accelerations of the mold expressed in fractional terms (%), have been illustrated in this figure as a function of time, plotted in minutes, as abscissae.

Figure 2:
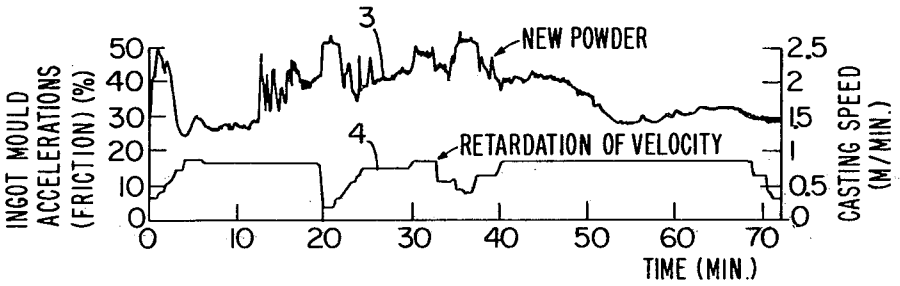

FIG. 2 illustrates a recording of a type which should be considered abnormal, meaning that the graph 3 of the accelerations of the ingot mold does not reflect the graph 4 of the speed in an approximate manner. It does nevertheless show the beneficial effect of a sensible change of powder. It is useful to observe on the graph corresponding to FIG. 1 that, after a change of the "basket" (occurring at the time t=33 minutes), a gradual restoration of the casting speed is manifested by a very rapid adaptation of the mold to the satisfactory value of its frictional actions.

I claim:

1. A method of controlling a continuous casting process in which the upper surface of molten metal within an oscillating mold is covered by a protective powder, the method comprising: covering said upper surface of molten metal with a powder of given composition; observing the external appearance of the metal issuing from the mold and recording the actual displacements or accelerations of the mold; and modifying the composition of the powder until the quality of the ingot skin can be considered as an optimum, to which corresponds the optimum lubrication of the mold and an ideal acceleration spectrum; subsequently recording the acceleration spectrum of the mold; comparing the recorded spectrum with the ideal spectrum; and modifying a parameter having an effect on the ingot quality at the time at which it is formed in the mold, so as to take up any difference observed between the two spectra.

2. A method as claimed in claim 1, in which the said parameter is the composition of the powder.

3. A method as claimed in claim 1, in which the said parameter is the ingot withdrawal speed.

4. A method as claimed in claim 1, in which the said parameter is a parameter of oscillation imposed on the mold.

5. A method as claimed in claim 1, including controlling a subsequent casting process having analogous characteristics by covering the upper surface of the initial molten metal with a powder composition modified to correspond to said ideal spectrum, and thereafter performing the steps of subsequent recording, comparing, and modifying a parameter as before.

6. A method as claimed in claim 1, including measuring vibrations of the mold along the axis of the ingot and along at least one direction contained in a transverse plane.

7. A method as claimed in claim 6, in which the vibrations along the axis of the ingot is measured within a range of frequencies lower than 80 times the maximum oscillation frequency imposed on the mold.

8. A method as claimed in claim 6, in which the vibrations in the transverse plane are measured within a range between 0.1 and 10 times the maximum frequency of oscillations imposed on the ingot mold.

* * * * *